US005785220A

United States Patent [19]

Leddy

[11] Patent Number: 5,785,220

[45] Date of Patent: Jul. 28, 1998

[54] SHOE BELT

[76] Inventor: Paul Leddy, 1100 W. Cornelia Unit 219, Chicago, Ill. 60657

[21] Appl. No.: 768,838

[22] Filed: Dec. 18, 1996

[51] Int. Cl.[6] ..... A45F 3/14

[52] U.S. Cl. ..... 224/677; 224/250

[58] Field of Search ..... 224/677, 674, 224/671, 250

[56] References Cited

U.S. PATENT DOCUMENTS

| | | | |
|---|---|---|---|
| 2,428,074 | 9/1947 | Hanson | 224/250 X |
| 3,361,312 | 1/1968 | Hutchinson | 224/677 X |
| 3,923,222 | 12/1975 | Groves | 224/250 X |
| 4,420,104 | 12/1983 | Dilenno | 224/677 X |
| 4,790,462 | 12/1988 | Kawaguchi | 224/250 |
| 4,863,083 | 9/1989 | Chen | 224/677 X |
| 4,867,359 | 9/1989 | Donovan | 224/250 X |
| 5,129,560 | 7/1992 | Herman | 224/674 X |
| 5,240,158 | 8/1993 | Walsh | 224/677 |

*Primary Examiner*—Renee S. Luebke
*Attorney, Agent, or Firm*—Kajane McManus

[57] ABSTRACT

The shoe belt of the present invention includes an adjustable strap engageable about a wearer's waist and which includes two shoe engaging pouches depending therefrom. The belt may also incorporate an identification/money purse which also depends from the strap. A person engaged in an activity such as rollerblading uses the belt to carry a pair of shoes along in a non-restricting, unencumbering manner.

2 Claims, 1 Drawing Sheet

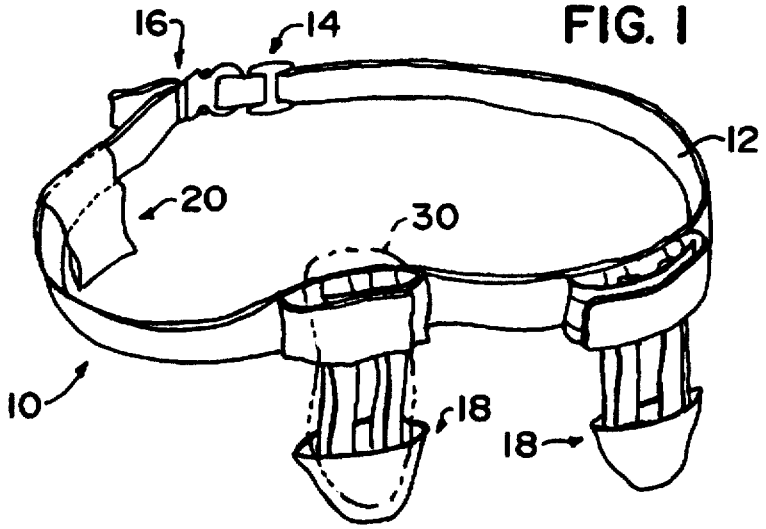
FIG. 1
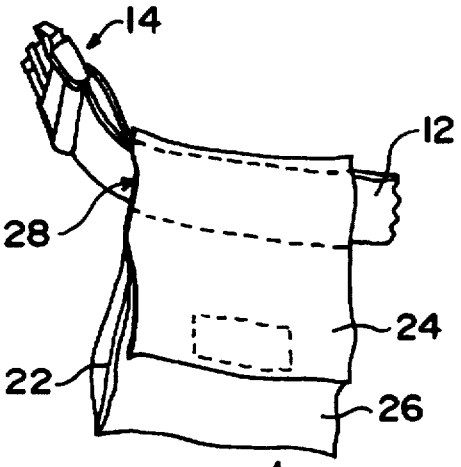
FIG. 3
FIG. 2
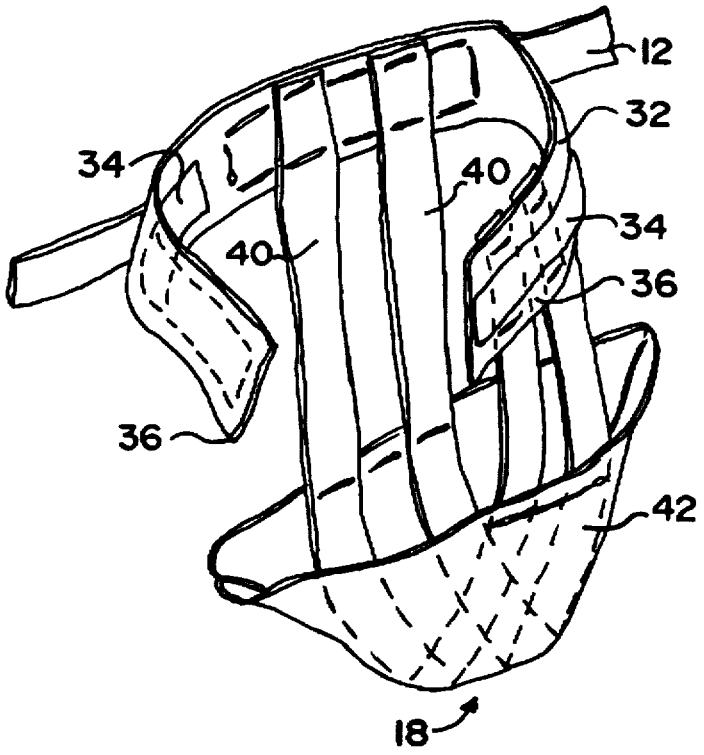

SHOE BELT

BACKGROUND OF THE INVENTION

1. Field of the Invention

The present invention relates to a belt which engages a pair of shoes about a wearer's waist. More particularly, the belt includes a pair of open, depending pouches, each of which engages one shoe of a pair and the belt being useful during such activities as rollerblading.

2. Prior Art

When rollerblading, a person may carry a pair of shoes about their neck, over a shoulder, or in a backpack. Shoes are usually taken along because various commercial establishments do not allow people in skates to enter. Also, when one is done rollerblading, shoes are preferably worn for protection of the feet.

A backpack is cumbersome and only laced shoes may be worn about the neck or over the shoulder, tending to interfere with activity as well.

Belts for engaging items other than shoes are found in the art. Previdi U.S. Pat. No. 2,558,382 discloses a golf ball and tee holder which is belt mounted.

Also, shoe bags are disclosed. For example, Alber U.S. Pat. No. 2,672,263 discloses a skate and shoe bag and Kliot U.S. Pat. No. 5,509,589 discloses a backpack for heavy bulky footwear.

SUMMARY OF THE INVENTION

Accordingly, it is a primary object of the invention to provide a simple shoe belt which carries a pair of shoes without interfering with an entertainment activity, such as rollerblading. A further object is to also provide means on the belt for carrying identification and/or money.

BRIEF DESCRIPTION OF THE DRAWINGS

Other objects and advantages of the invention will become more apparent upon perusal of the detailed description thereof and upon inspection of the drawings in which:

FIG. 1 is a perspective view of the shoe belt of the present invention.

FIG. 2 is an enlarged view of one shoe pouch of the belt, showing same in an open condition thereof.

FIG. 3 is an enlarged view of a small identification/money purse provided on the belt.

DESCRIPTION OF THE PREFERRED EMBODIMENT

Referring now to the drawings in greater detail, there is illustrated therein the shoe belt of the present invention generally identified by the reference numeral 10.

The shoe belt includes a strap 12 which engages about a wearer's waist through a buckle 14 provided for the strap 12. The buckle 14 in a preferred embodiment includes frictional structure 16 thereon through which the strap 12 passes in a manner to be adjustable in length.

Depending from the strap 12 are a pair of shoe engaging pouches 18 and a small money/identification purse 20.

The purse 20 comprises a pocket 22 having a flap 24 extending over an opening thereinto and being releasably engageable to one exterior surface 26 of the pocket 22.

The purse 20 includes a sleeve 28 which slidingly engages about the strap 12, with the pocket 22 and flap 24 depending therebelow. It is proposed that a wearer of the belt 10 may carry money and/or identification in the purse 20, eliminating the need for a separate structure such as a pack, or shoulder bag, which is encumbering during activities such as rollerblading.

Turning now to the shoe pouches 18, a shoe 30 is shown engaged within one of the pouches 18 in phantom in FIG. 1. FIG. 2 shows one pouch 18 to comprise a releasable band 32 which is fixed to the strap 12. The band 32 includes engaging members 34 on ends 36 thereof which cooperate to fix the band 32 about the shoe 30 supported within the pouch 18. A pair of parallel strips 40 extend downwardly a predetermined distance from an area of the band 32 fixed to the strap 12 and then reverse direction, attaching to one end 36 of the band 32, forming the pouch 18 which depends from the band 12. To ensure that the strips 40 do not separate and that a shoe 30 will be unable to disengage from a position within the strips 40, an end cap 42 is secured about the strips 40, at a centered or bottom position along the length thereof, to form a shoe toe basket 42 for the pouch 18.

In use, a wearer places a toe of a shoe 30 within the basket 42 and brings the ends 36 of the band 32 about the shoe 30, the band ends 36 engaging one another about the shoe 30 and fixing the shoe 30 to the belt strap 12. Obviously the same procedure is followed for the second shoe of a pair, filling the second pouch 18.

The strap 12 is then engaged about the wearer's waist with the shoe pouches 18 being positioned behind the wearer. Rollerblading may then begin without encumbrance inasmuch as the shoes 30 do not interfere with free motion and do not add an uneven distribution of weight to the wearer. As described above, the shoe belt 10 of the present invention provides a number of advantages, some of which have been described above and others of which are inherent in the invention. Also modifications may be proposed to the shoe belt 10 without departing from the teachings herein. Accordingly, the scope of the invention is only to be limited as necessitated by the accompanying claims.

I claim:

1. A shoe belt comprising an adjustable strap which engages about a waist of a wearer and two shoe engaging pouches depending therefrom, each shoe pouch comprising a band, a portion of which is fixed to the strap, the band having two cooperating free ends, each free end incorporating an engaging member for engaging the free ends together, a pair of parallel strips depending from the band in the portion fixed to the strap, the strips reversing direction at a predetermined position below the strap and engaging one free end of the band, the pouch further including a shoe toe basket engaged over and to a lowermost area of the strips for maintaining parallel orientation of the strips and for securely engaging a toe of a shoe therein.

2. The belt of claim 1 further including an identification/money purse which depends from the strap.

* * * * *